US005790988A

United States Patent [19]

Guadagnino, Jr. et al.

[11] Patent Number: 5,790,988

[45] Date of Patent: Aug. 11, 1998

[54] PROTECTIVE HEADGEAR

[76] Inventors: Victor Guadagnino, Jr.; Jayne M. Guadagnino, both of 215 Hunter St., Easton, Pa. 18045

[21] Appl. No.: 892,285

[22] Filed: Jul. 14, 1997

[51] Int. Cl.[6] ..... A42B 3/00

[52] U.S. Cl. ..... 2/411; 2/425

[58] Field of Search ..... 2/410, 411, 417, 2/418, 421, 425, 424; D29/102, 106

[56] References Cited

U.S. PATENT DOCUMENTS

| | | | |
|---|---|---|---|
| 532,567 | 1/1895 | Larwood, Jr. | 2/425 |
| 3,555,561 | 1/1971 | Neis | 2/411 |
| 3,820,780 | 6/1974 | Tarbox | 2/425 |
| 4,058,854 | 11/1977 | Rhee | 2/425 |
| 4,095,294 | 6/1978 | Winterbottom | 2/424 |
| 4,222,122 | 9/1980 | Toms | 2/425 |
| 4,279,038 | 7/1981 | Bruckner et al. | 2/425 |
| 5,437,064 | 8/1995 | Hamaguchi | 2/425 |
| 5,604,935 | 2/1997 | Nezer | 2/410 |
| 5,615,419 | 4/1997 | Williams | 2/411 |

*Primary Examiner*—Michael A. Neas
*Attorney, Agent, or Firm*—John Lezdey

[57] ABSTRACT

A light-weight protective headgear for athletes and persons involved in activities involving a high falling risk. The protective headgear of this invention comprises a one-piece body of form-molded soft resilient closed cell foam material covered with a tough pliable surface coating having a double securing feature i.e. under the chin of the user and at the back of the head and when adjusted in position will stay fixed throughout usage. The protective headgear also provides adequate ventilation through spaces in the tip portion.

13 Claims, 1 Drawing Sheet

PROTECTIVE HEADGEAR

FIELD OF THE INVENTION

The present invention relates to an adjustable head guard and more particularly, to a universal protective headgear especially for protecting youths engaged in contact sports and other injury risking activities.

BACKGROUND OF THE INVENTION

A wide variety of protective headgear comprising features for protecting a user's head and ears is available, but is generally unsatisfactory for use by youths. For example, a football helmet comprises a hard, rigid plastic shell with an interior padding and/or webbing for absorbing blows to a wearer's head. The football helmet, like similar types of headgear, is bulky and heavy. The shell does not fit snugly about the wearer's head and is retained on the wearer's head by a chin strap. If worn by children up to about 15 years of age, these ill-fitting helmets could produce considerable stress and strain on the youthful wearer's neck. The helmet may tilt significantly when impacted with sufficient force or in contact with a hard surface. This of course is highly undesirable since the helmet thus moved could uncover parts of the head. The hard shell can also cause injury to other players who are not familiar with proper form or defenses.

Another disadvantage of a conventional football helmet is that the outer shell is made of a rigid plastic nonporous material and the interior padding is also hydrophobic resilient plastic. As a result, the head cannot be readily ventilated, which leads to perspiration. Excessive perspiration is annoying but most importantly may effect performance by impairing vision.

Therefore, there exists a need for a headgear for young athletes, particularly a headgear for youthful football players which affords protection, can be easily fitted and provides adequate ventilation to avoid excessive perspiration. Most importantly, a youthful football helmet must provide superior protection, i.e. a strong fit to remain in place after repeated impacts.

SUMMARY OF THE INVENTION

According to this invention, the protective adjustable headgear for athletes and persons involved in activities involving a high falling risk. The protective headgear of this invention comprises a one-price body of form molded soft resilient closed-cell foam material covered with a tough pliable surface coating. More particularly, the protective headgear comprises a shock absorbing shell of integral construction comprising a horizontal band which encompasses the literal circumference of the wearer's head having integrally molded front portion, two subtending side portions, a rear portion and an upper portion. Each of the two subtending side portions are positioned to fit over and protect the ear. These subtending side portions comprise a forwardly obtuse angled front segment having a fastening means adjustably and releasably attached thereto for fitting under the chin, and an open back segment which is positioned below and parallel to the horizontal band. This back segment when secured with fastening means which are adjustably and releasably attached thereto extends to cover the neck vertebrae on the back of the head. The upper portion comprises a plurality of spaced longitudinal bands intersected by a plurality of cross membered bands to provide protection to the occipital region of the head, as well as, providing a plurality of openings primarily for ventilation purposes.

In this configuration, the double securing feature according to this invention, the head protected can be relied upon to closely follow the contour of the head of the wearer such that it will not slip laterally or forwardly and when adjusted in position will stay fixed through usage. Furthermore, in the arrangement, it is possible to obtain a ready adjustment to various head sizes which cannot be obtained with only a chin strap.

In a preferred embodiment, the upper portion comprises a pair of spaced longitudinal bands interacted by a centrally positioned cross member band adapted to retain such headgear on a wearer's head and to provide openings for ventilation purposes.

Adequate ventilation of the helmet is provided by the openings or spaces in the top portion where most of the heat built-up is dissipated along with the ear openings in the subtending portions and the space between the open back portion. Preferably, the protective headgear has about six spaces in the top portions.

It is therefore an object of the present invention to provide a new and improved protective headgear which can be readily and snugly fit by adjustment.

It is another object of the present invention to provide a new and improved protective headgear which may be easily and efficiently manufactured.

A further object of the present invention to provide a new and improved protective headgear which is of durable and reliable construction.

An eve n further object is to provide a new and improved protective headgear having a low cost of manufacture including both materials and labor.

Still yet a further object of the present invention is to provide a new and improved protective headgear which can fit a wide variety of head sizes.

Yet another object is to provide a new and improved protective headgear that includes a chin strap and a open back portion strap to secure the headgear so that it will stay in place despite direct or glancing blows to the head.

Still a further object is to provide a new and improved protective headgear for use as a helmet for youths for flag football.

Although the invention is illustrated and described herein as embodied in the protective headgear made of elastic material for athletes, it is nevertheless not intended to be limited to the details shown, since various modifications and structural changes may be made therein without departing from the spirit of the invention and within the scope and range of equivalents of the claims.

The invention will be better understood and the above objects, as well as, objects other than those set forth above will become more apparent after a study of the following detailed description. In the drawings, wherein like reference characters denote corresponding ports throughout the several views.

DESCRIPTION OF THE PREFERRED EMBODIMENTS

Figure 1:
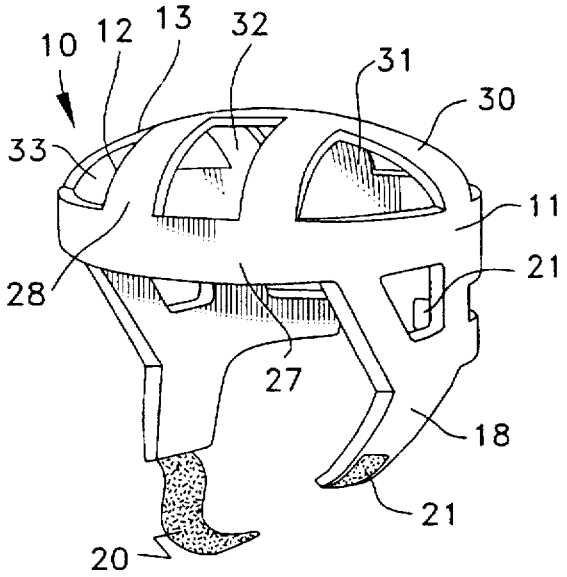
FIG. 1 is a perspective view of the front of the protective headgear of this invention.
Figure 2:
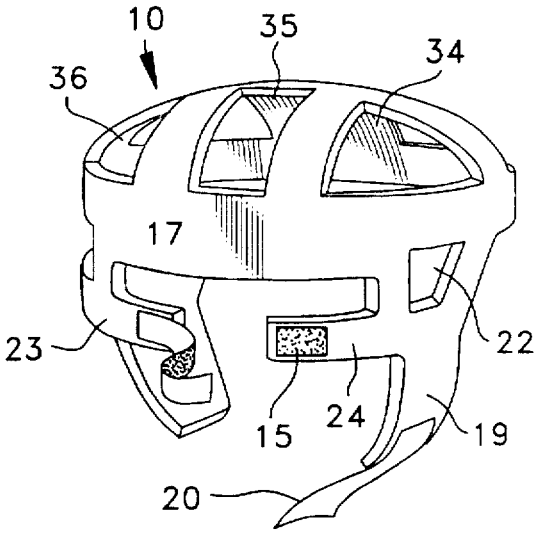
FIG. 2 is a perspective view of the rear of the protective headgear of this invention.
Figure 3:
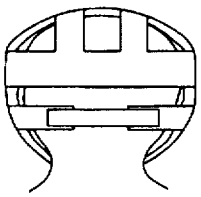
FIG. 3 is an elevation of the rear view of a user's head wearing the protective headgear of FIGS. 1 and 2.
Figure 4:
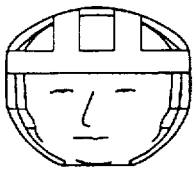
FIG. 4 is an elevation of the front view of the user's head wearing the protective headgear of FIG. 3.
Figure 5:
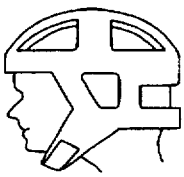
FIG. 5 is a left side elevation of the headgear of FIGS. 3 and 4, showing the double securing feature, i.e., the chin strap and the open back strap secured with VELCRO fasteners.
Figure 6:
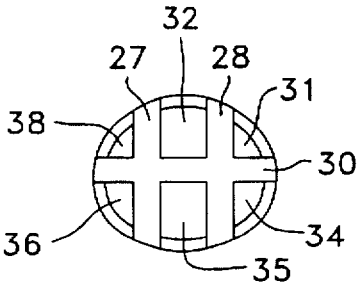
FIG. 6 is the view of the protective headgear of this invention as viewed from the top.

Referring to the specific embodiment of the invention illustrated in FIGS. 1–5 of the drawings which comprises a helmet device generally indicated by the numeral 10 in FIGS. 1 and 2. The helmet comprises a protective member, preferably unitary molded from a suitable resilient material 12 capable of absorbing energy such as a plastic, i.e. polystyrene or polyurethane foam or a synthetic rubber foam and similar materials. A suitable surface coating 13 preferably smooth, covers the entire outer surface of the resilient material. Preferably the outer surface coating 13 is a tough, pliable, tear resistant plastic material. The coating 13 can be formed during heating and molding of a resilient foam material to produce a fused coating. Alternatively, the surface coating 13 can be applied on the foam material by laminating, dipping, brushing or spraying.

Suitable plastic coatings include thermosetting resins, phenolic resins, amino resins, polyester resins, epoxy resins, rigid foams of polyurathane, silicone polymers alkyl resins. Suitable thermo plastic coatings such as acrylic resins and polyvinge chloride are also useful. It is also contemplated within the concept of the invention that materials such as nylon and KEVLAR (marketed by E. I. duPont de Nemours & Co., Inc., Wilmington, Del.).

Protective headgear 10 comprises a one piece body of form molded foam 12 covered with a tough pliable surface coating 13. Headgear 10 defines the following members: a horizontal band 11, and a top portion 30 comprising two spaced parallel longitudinal bands 27 and 28 intersected by a central cross member 29 each of which members are integral, flexible to each other and elastically connected to each other. The configuration of the longitudinal bands 27 and 29 and cross member 30 are adapted to retain the helmet on the top of the person's head providing openings 31, 32, 33, 34, 35 and 36 in the top of the headgear. These openings provide adequate ventilation and comfort to the wearer of the headgear 10 while the cross members provide protection to the occipital region of the head.

The horizontal band 11 comprises a front 14, subtending side portions 15 and 16 and a rear portion 17. Thus the horizontal band 11 forms a continuous protective band around the forehead, temples and the back of the head. The subtending side portions 15 and 16 comprise obtuse angled sections 18 and 19 to which fastening means 20 and 21 are adjustably and releasably fitted under the chin and an open back section 23 and 24 positioned below and parallel to the rear portion 17 of the horizontal band 11. (See FIG. 2) A fastening means 25 and 26 is attached to the back section for adjustably and releasably fitting the back of the head.

Any conventional fastening means can be used to secure the chin and the back of the head to the headgear. Fastening means by a separable hook and strap such as VELCRO fasteners (marketed by Velcro, Inc., New Hampshire) are preferred.

Further subtending side portions 15 and 16 have openings 21 and 22 which generally outline the ears for hearing purposes.

In practice, the interior diameter and length of the cross member is chosen to provide a snug fit about the wearer's head. Various sizes of headgear can be provided. Typically for youths, the cross members are about 4–6 inches long and about 1–2 inches wide.

As seen from the above description, the headgear 10 is adapted to be worn on the head of a person to protect the head from injury while at the same time providing openings for various parts of the head to permit seeing, talking, hearing, ventilation, etc. The headgear 10 is easily put on and removed, a feature particularly important to youthful users. Because the helmet is not rigid it tends to conform easily to the head and to the various features of the head of the wearer. The upper part of the head is inserted into the headgear through the large opening and the headgear is pulled down on the head by tugging on the subtending portions 15 and 16. Suitable adjustment of the helmet can be made first with the headgear in place on the head by adjusting the back sections 23 and 24 with fastener means 20 and 21. Then the chin fastener means is secured by fastener means 25 and 26.

The unique construction and design of the headgear of FIGS. 1–6 provides protection to the head in various contact sports such as youth football where the necessity for a conventional football helmet may be obviated since the collision forces involved are generally much lower for children under thirteen.

It is understood, that in this invention, when reference is made to a protective headgear for youths engaged in football, its use is not thereto restricted. For example, such headgear could be used for cycling, rollerblading rollerskating, skateboarding, racquetball and the like. It is also contemplated since materials of construction can made the headgear buoyant in water surfboarding and windsurfing are excellent examples in which the user can benefit from wearing headgear of the present invention.

From the foregoing description, specific embodiments have been disclosed herein, the invention is not limited thereto, and the language used in this specification is intended as descriptive rather than limiting as those skilled in the art with the specification before them will be able to make modifications therein without departing from the spirit of the invention claimed.

What is claimed is:

1. A protective headgear comprising a shock absorbing shell of integral construction which comprises a horizontal band, which encompasses the lateral circumference of the wearer's head, having integrally molded front portion, two subtending side portions, a rear portion and an upper portion;

said subtending side portions comprise a forwardly obtuse angled segment having a fastening means adjustably and releasably attached thereto for fitting under the chin and an open back segment which is positioned below and parallel to said horizontal band and having a fastening means adjustably and releasably attached thereto for fitting the back of the head; and said upper portion comprises a plurality of spaced longitudinal bands intersected by a cross member band.

2. The protective headgear of claim 1 wherein said headgear is constructed entirely of resilient foam covered with a tough pliable surface coating on the outer surface of said headgear.

3. The protective headgear of claim 2 wherein said resilient foam is selected from a group consisting of polystyrene foam, a polyurethane foam and a synthetic rubber foam.

4. The protective headgear of claim 2 wherein said surface coating is a thermosetting resin-coating.

5. The protective headgear of claim 1 wherein the upper portion comprises a pair of spaced longitudinal bands intersected by centrally positioned cross member band adapted to retain said headgear on a wearer's head and to provide openings for ventilation purposes.

6. The protective headgear of claim 1 wherein said headgear has additional ventilation openings.

7. The protective headgear of claim 1 wherein said subtending side portions include opening for the ears.

8. The protective headgear of claim 1 wherein said fastening means is a separable hook and loop fastener.

9. The protective headgear of claim 8, wherein said hook and loop fastener is made of nylon.

10. The protective headgear of claim 8, wherein said hook and loop fastener is made of a synthetic polymer material.

11. The protective headgear of claim 1 wherein said fasteners means for fitting under the chin is provided for attachment under said obtuse angled front segment.

12. The protective headgear of claim 1 wherein said open back segment when secured extends to cover the neck vertebrae on the back of the head.

13. The protective headgear of claim 1 configured as a youth football helmet.

* * * * *